US009151457B2

(12) United States Patent
Pickard et al.

(10) Patent No.: US 9,151,457 B2
(45) Date of Patent: Oct. 6, 2015

(54) LIGHTING DEVICE AND METHOD OF INSTALLING LIGHT EMITTER

(75) Inventors: Paul Kenneth Pickard, Morrisville, NC (US); Nicholas W. Medendorp, Jr., Raleigh, NC (US); Mark D. Edmond, Raleigh, NC (US); Dong Lu, Cary, NC (US); Curt Progl, Raleigh, NC (US); Mark Dixon, Morrisville, NC (US)

(73) Assignee: Cree, Inc., Durham, NC (US)

( * ) Notice: Subject to any disclaimer, the term of this patent is extended or adjusted under 35 U.S.C. 154(b) by 17 days.

(21) Appl. No.: 13/365,844

(22) Filed: Feb. 3, 2012

(65) Prior Publication Data

US 2013/0201679 A1 Aug. 8, 2013

(51) Int. Cl.

| | |
|---|---|
| ***F21V 15/00*** | (2015.01) |
| ***F21V 17/00*** | (2006.01) |
| ***F21S 8/02*** | (2006.01) |
| ***F21V 15/01*** | (2006.01) |
| *F21V 3/00* | (2015.01) |
| *F21Y 101/02* | (2006.01) |

(52) U.S. Cl.

CPC ..... *F21S 8/026* (2013.01); *F21V 15/01* (2013.01); *F21V 3/00* (2013.01); *F21Y 2101/02* (2013.01); *Y10T 29/49002* (2015.01)

(58) Field of Classification Search

CPC ..... F21S 8/026; F21V 15/01

USPC ..... 362/145, 151, 363–366, 147–150, 362/249.02, 362, 800

See application file for complete search history.

(56) References Cited

U.S. PATENT DOCUMENTS

| | | | |
|---|---|---|---|
| 2,675,466 | A | 4/1954 | Baker |
| 3,302,918 | A | 2/1967 | Cohen |
| 4,044,246 | A | 8/1977 | Docimo et al. |
| 4,302,798 | A | 11/1981 | Sit |
| 4,313,154 | A | 1/1982 | Capostagno et al. |
| 5,407,143 | A | 4/1995 | Nakai et al. |
| 5,440,471 | A | 8/1995 | Zadeh |
| 5,546,291 | A | 8/1996 | Simes |

(Continued)

FOREIGN PATENT DOCUMENTS

| | | |
|---|---|---|
| CN | 201069133 Y | 6/2008 |
| DE | 297 06 402 | 9/1997 |

(Continued)

OTHER PUBLICATIONS

Glimpse, Lighting Science, www.lsgc.com, Sep. 20, 2011, pp. 1-2.

(Continued)

*Primary Examiner* — Jason Moon Han

(74) *Attorney, Agent, or Firm* — Burr & Brown, PLLC

(57) ABSTRACT

A lighting device comprising a junction box, a trim element and a solid state light emitter, at least a portion of a space defined by regions of the trim element within a space defined by regions of the junction box, the light emitter within the trim element space. A lighting device comprising a trim element (with at least two regions) and a solid state light emitter, in which at least a first part of the first region can be positioned in a first space with the second region outside the first space, the light emitter within the first part. A lighting device, comprising a trim element (which comprises at least two regions), part of an exterior of which defines a first space, at least a first part of the first region within the first space, a solid state light emitter within the first part. Methods of installing a light emitter.

47 Claims, 4 Drawing Sheets

(56) References Cited

U.S. PATENT DOCUMENTS

| | | | | |
|---|---|---|---|---|
| 5,707,143 | A | 1/1998 | Hentz | |
| 5,826,970 | A | 10/1998 | Keller et al. | |
| 5,836,677 | A | 11/1998 | Connors et al. | |
| 6,127,783 | A | 10/2000 | Pashley et al. | |
| 6,361,193 | B1 | 3/2002 | Gabrius et al. | |
| 6,545,216 | B1 | 4/2003 | Bell et al. | |
| 6,899,445 | B2 | 5/2005 | Hyder | |
| 6,979,108 | B1 | 12/2005 | Berge | |
| 7,025,477 | B2 | 4/2006 | Blessing et al. | |
| 7,102,172 | B2 | 9/2006 | Lynch et al. | |
| 7,125,146 | B2 | 10/2006 | Willis et al. | |
| 7,244,037 | B2 | 7/2007 | Koren | |
| 7,258,467 | B2 | 8/2007 | Saccomanno et al. | |
| 7,374,327 | B2 | 5/2008 | Schexnaider | |
| 7,458,706 | B1 | 12/2008 | Liu et al. | |
| 7,614,769 | B2 | 11/2009 | Sell | |
| 7,670,021 | B2 | 3/2010 | Chou | |
| 7,722,220 | B2 | 5/2010 | Van De Ven | |
| 7,722,227 | B2 | 5/2010 | Zhang et al. | |
| 7,771,085 | B2 | 8/2010 | Kim | |
| 7,794,114 | B2 | 9/2010 | Medendorp, Jr. | |
| 7,810,736 | B2 | 10/2010 | Smith et al. | |
| 7,810,960 | B1 | 10/2010 | Soderman et al. | |
| 7,828,465 | B2 | 11/2010 | Roberge et al. | |
| 7,854,616 | B2 | 12/2010 | Janos et al. | |
| 7,878,692 | B2 | 2/2011 | Soderman et al. | |
| 7,906,793 | B2 | 3/2011 | Negley | |
| 7,918,591 | B2 | 4/2011 | Lynch | |
| 7,950,832 | B2 | 5/2011 | Tanaka et al. | |
| 7,959,332 | B2 * | 6/2011 | Tickner et al. | 362/373 |
| 7,980,736 | B2 | 7/2011 | Soderman et al. | |
| 7,993,034 | B2 | 8/2011 | Wegner | |
| 8,022,641 | B2 | 9/2011 | Janik et al. | |
| 8,092,042 | B2 | 1/2012 | Wilcox | |
| 8,201,968 | B2 * | 6/2012 | Maxik et al. | 362/235 |
| 8,232,739 | B2 | 7/2012 | Underwood et al. | |
| 8,246,203 | B2 | 8/2012 | Hancock et al. | |
| 8,256,919 | B2 | 9/2012 | Holder et al. | |
| 8,371,727 | B2 * | 2/2013 | Dreeben et al. | 362/364 |
| 8,454,204 | B1 | 6/2013 | Chang et al. | |
| 2002/0172042 | A1 * | 11/2002 | Wen-Chung | 362/276 |
| 2006/0077684 | A1 | 4/2006 | Yuen | |
| 2006/0091272 | A1 | 5/2006 | Piel et al. | |
| 2006/0274531 | A1 | 12/2006 | Kopf et al. | |
| 2007/0019418 | A1 | 1/2007 | Czech et al. | |
| 2007/0041220 | A1 | 2/2007 | Lynch | |
| 2007/0137074 | A1 | 6/2007 | Van de Ven | |
| 2007/0139920 | A1 | 6/2007 | Van de Ven | |
| 2007/0139923 | A1 | 6/2007 | Negley | |
| 2007/0170447 | A1 | 7/2007 | Negley | |
| 2007/0171145 | A1 | 7/2007 | Coleman | |
| 2007/0230172 | A1 | 10/2007 | Wang | |
| 2007/0236911 | A1 | 10/2007 | Negley | |
| 2007/0263393 | A1 | 11/2007 | Van de Ven | |
| 2007/0267983 | A1 | 11/2007 | Van de Ven | |
| 2007/0274063 | A1 | 11/2007 | Negley | |
| 2007/0274080 | A1 | 11/2007 | Negley | |
| 2007/0278503 | A1 | 12/2007 | Van de Ven | |
| 2007/0278934 | A1 | 12/2007 | Van de Ven | |
| 2007/0279440 | A1 | 12/2007 | Negley | |
| 2007/0279903 | A1 | 12/2007 | Negley | |
| 2007/0280624 | A1 | 12/2007 | Negley | |
| 2008/0084685 | A1 | 4/2008 | Van de Ven | |
| 2008/0084700 | A1 | 4/2008 | Van de Ven | |
| 2008/0084701 | A1 * | 4/2008 | Van De Ven et al. | 362/373 |
| 2008/0088248 | A1 | 4/2008 | Myers | |
| 2008/0089053 | A1 | 4/2008 | Negley | |
| 2008/0106895 | A1 | 5/2008 | Van de Ven | |
| 2008/0112168 | A1 | 5/2008 | Pickard | |
| 2008/0112170 | A1 | 5/2008 | Trott | |
| 2008/0122364 | A1 | 5/2008 | McClellan | |
| 2008/0130285 | A1 | 6/2008 | Negley | |
| 2008/0136313 | A1 | 6/2008 | Van de Ven | |
| 2008/0137347 | A1 | 6/2008 | Trott | |
| 2008/0170398 | A1 | 7/2008 | Kim | |
| 2008/0212330 | A1 | 9/2008 | Hartmann et al. | |
| 2008/0219001 | A1 | 9/2008 | Russell | |
| 2008/0232116 | A1 | 9/2008 | Kim | |
| 2008/0259589 | A1 | 10/2008 | Van de Ven | |
| 2010/0103678 | A1 | 4/2010 | Van De Ven et al. | |
| 2010/0219760 | A1 | 9/2010 | Tanaka et al. | |
| 2010/0270903 | A1 | 10/2010 | Jao et al. | |
| 2012/0113642 | A1 * | 5/2012 | Catalano | 362/249.02 |
| 2012/0206926 | A9 | 8/2012 | Chou | |
| 2013/0016516 | A1 | 1/2013 | Trott et al. | |

FOREIGN PATENT DOCUMENTS

| | | | |
|---|---|---|---|
| EP | 1 950 491 | A1 | 7/2008 |
| WO | 2004/023424 | | 3/2004 |
| WO | 2006/105346 | A2 | 10/2006 |
| WO | 2007/099860 | A1 | 9/2007 |

OTHER PUBLICATIONS

Glimpse, Lighting Science Group Corporation, Surface Mount LED Lighting Fixture, Sep. 2011, pp. 1-8.
U.S. Appl. No. 13/826,271, filed Mar. 14, 2013, Pickard et al.
U.S. Appl. No. 29/449,729, filed Mar. 15, 2013, Snell et al.
Narendran et al., PIER Lighting Research Program Project 2.3 Low-Profile LED Luminaries, Lighting Research Center, California Energy Commission, CLC-500-2005-141-A4, Apr. 2007, 84 pages.
Philips Solid-State Lighting Solutions, Inc., Philips eW Downlight Powercore Retailer Guide, Copyright 2009, 16 pages.
Inteltech Corp., Inteltech Corp. Silescent 100i LV Light Installation Instructions (REV C), May 2008, 4 pages.
Inteltech Corp., Inteltech Corp. Silescent 100i LV Light Specifications, May 2008, 2 pages.
Cree, Inc., Specification Sheets for Cree LR6, 2012, 4 pages.
Cree, Inc., Cree LED Lighting Catalog, Fall 2013, 7 pages.
Cree, Inc., Installation Instructions for Cree LR6, 2013, 2 pages.
Matsushita Electric Works/Panasonic, Matsushita Electric Works, Ltd. Annual Report, 2007, Jun. 30, 2007, 2 pages.
PennWell Publishing, LEDs Magazine, Jan./Feb. 2008, 52 pages.
Matsushita Electric Works/Panasonic, Specification Sheet for MFORCE-R NNN20608-K10, undated, 1 page.
Matsushita Electric Works/Panasonic, Specification Sheet for MFORCE NNN20605, undated, 1 page.
Matsushita Electric Works/Panasonic, Catalog page for MFORCE, undated, 1 page.
IES/IALD/US Dept. of Energy, 2009 NGL Showcase, Dec. 3-4, 2009, 52 pages.
Sea Gull Lighting/Generation Brands, Sea Gull Lighting Brochure, Dec. 21, 2009, 4 pages.
Sea Gull Lighting/Generation Brands, Sea Gull Lighting Installation Instructions, Jan. 22, 2010, 3 pages.
J.D. Bullough, National Lighting Product Information Program, Rensselaer Polytechnic Institute, Lighting answers: LED lighting systems, May 28, 2003, 23 pages.
Creative Publishing International, Lighting Design & Installation: Techniques & Projects for Lighting Your Home and Landscape, 2003.
Gary Steffy, John Wiley & Sons, Architectural Lighting Design, 2008, 10 pages.
Craig DiLouie, LEDs Magazine, Controlling LED lighting systems: introducing the LED driver, Dec. 2004, 4 pages.
Pacific Energy Center, Luminaires, A Pacific Energy Center Factsheet, May 1997, 7 pages.
Parker, Concise Encyclopedia of Science & Technology, 1997, 3 pages.

* cited by examiner

LIGHTING DEVICE AND METHOD OF INSTALLING LIGHT EMITTER

FIELD OF THE INVENTIVE SUBJECT MATTER

The inventive subject matter relates to the field of general illumination. In some aspects, the inventive subject matter relates to a lighting device that comprises a trim element and one or more solid state light emitters. In some aspects, the inventive subject matter relates to a lighting device that comprises a trim element and at least a first solid state light emitter, in which the trim element comprises at least a first region that comprises at least a first concave portion, at least part of which can fit in a first space (in some aspects defined by a junction box), and in which the first solid state light emitter is within the first space. In some aspects, the inventive subject matter relates to a method of installing a light emitter, comprising inserting at least a first part of a first region of a trim element into a first space (in some aspects defined by a junction box), with a second region of the trim element outside the first space, at least a first solid state light emitter within the first part of the first region.

BACKGROUND

There is an ongoing effort to develop systems that are more energy-efficient. A large proportion (some estimates are as high as twenty-five percent) of the electricity generated in the United States each year goes to lighting, a large portion of which is general illumination (e.g., downlights, flood lights, spotlights and other general residential or commercial illumination products). Accordingly, there is an ongoing need to provide lighting that is more energy-efficient.

Solid state light emitters (e.g., light emitting diodes) are receiving much attention due to their energy efficiency. It is well known that incandescent light bulbs are very energy-inefficient light sources; about ninety percent of the electricity they consume is released as heat rather than light. Fluorescent light bulbs are more efficient than incandescent light bulbs (by a factor of about 10) but are still less efficient than solid state light emitters, such as light emitting diodes.

LEDs and other solid state light emitters may be energy efficient, so as to satisfy ENERGY STAR® program requirements. ENERGY STAR program requirements for LEDs are defined in "*ENERGY STAR®* Program Requirements for Solid State Lighting Luminaires, Eligibility Criteria—Version 1.1", Final: Dec. 19, 2008, the disclosure of which is hereby incorporated herein by reference in its entirety as if set forth fully herein.

In addition, as compared to the normal lifetimes of solid state light emitters, e.g., light emitting diodes, incandescent light bulbs have relatively short lifetimes, i.e., typically about 750-1000 hours. In comparison, light emitting diodes, for example, have typical lifetimes between 50,000 and 70,000 hours. Fluorescent bulbs have longer lifetimes than incandescent lights (e.g., fluorescent bulbs typically have lifetimes of 10,000-20,000 hours), but provide less favorable color reproduction. The typical lifetime of conventional fixtures is about 20 years, corresponding to a light-producing device usage of at least about 44,000 hours (based on usage of 6 hours per day for 20 years). Where the light-producing device lifetime of the light emitter is less than the lifetime of the fixture, the need for periodic change-outs is presented. The impact of the need to replace light emitters is particularly pronounced where access is difficult (e.g., vaulted ceilings, bridges, high buildings, highway tunnels) and/or where change-out costs are extremely high.

LED lighting systems can offer a long operational lifetime relative to conventional incandescent and fluorescent bulbs. LED lighting system lifetime is typically measured by an "L70 lifetime", i.e., a number of operational hours in which the light output of the LED lighting system does not degrade by more than 30%. Typically, an L70 lifetime of at least 25,000 hours is desirable, and has become a standard design goal. As used herein, L70 lifetime is defined by Illuminating Engineering Society Standard LM-80-08, entitled "*IES Approved Method for Measuring Lumen Maintenance of LED Light Sources*", Sep. 22, 2008, ISBN No. 978-0-87995-227-3, also referred to herein as "LM-80", the disclosure of which is hereby incorporated herein by reference in its entirety as if set forth fully herein, and/or using the lifetime projections found in the ENERGY STAR Program. Requirements cited above or described by the ASSIST method of lifetime prediction, as described in "*ASSIST Recommends . . . LED Life For General Lighting: Definition of Life*", Volume 1, Issue 1, February 2005, the disclosure of which is hereby incorporated herein by reference as if set forth fully herein.

Heat is a major concern in obtaining a desirable operational lifetime for solid state light emitters. As is well known, an LED also generates considerable heat during the generation of light. The heat is generally measured by a "junction temperature", i.e., the temperature of the semiconductor junction of the LED. In order to provide an acceptable lifetime, for example, an L70 of at least 25,000 hours, it is desirable to ensure that the junction temperature should not be above 85° C. In order to ensure a junction temperature that is not above 85° C., various heat sinking schemes have been developed to dissipate at least some of the heat that is generated by the LED. See, for example, Application Note: CLD-APO6.006, entitled *Cree® Xlamp® XR Family* & 4550 *LED Reliability*, published at cree.com/xlamp, September 2008.

Although the development of solid state light emitters (e.g., light emitting diodes) has in many ways revolutionized the lighting industry, some of the characteristics of solid state light emitters have presented challenges, some of which have not yet been fully met. For example, solid state light emitters are commonly seen in indicator lamps and the like, but are not yet in widespread use for general illumination.

Accordingly, for these and other reasons, efforts have been ongoing to develop ways by which solid state light emitters, which may or may not include luminescent material(s), can be used in place of incandescent lights, fluorescent lights and other light-generating devices in a wide variety of applications. In addition, where light emitting diodes (or other solid state light emitters) are already being used, efforts are ongoing to provide solid state light emitters that are improved, e.g., with respect to energy efficiency, color rendering index (CRI Ra), contrast, efficacy (lm/W), cost, duration of service, convenience and/or availability for use in different aesthetic orientations and arrangements.

In order to encourage development and deployment of highly energy efficient solid state lighting (SSL) products to replace several of the most common lighting products currently used in the United States, including 60-Watt A19 incandescent and PAR 38 halogen incandescent lamps, the Bright Tomorrow Lighting Competition (L Prize™) has been authorized in the Energy Independence and Security Act of 2007 (EISA). The L Prize is described in "*Bright Tomorrow Lighting Competition* (*L Prize*™)", May 28, 2008, Document No. 08NT006643, the disclosure of which is hereby incorporated herein by reference in its entirety as if set forth fully herein. The L Prize winner must conform to many product requirements including light output, wattage, color rendering index, correlated color temperature, expected lifetime, dimensions and base type.

Presently, the predominant lighting fixture in specification homes is the dome light. Because the dome light is comparatively inexpensive, provides adequate light in a relatively even distribution, and in some cases does not require anything other than a simple junction box in a ceiling to install, it is in widespread use.

Currently, dome lights typically use two 60 Watt A-lamps shining light through a low optical efficiency dome to deliver between 600-900 lumens into the space. One approach to providing an energy-efficient replacement for such a fixture would be to simply replace the A-lamps with an LED source. Such an approach could provide a drop from 120 Watts to 24 Watts (2×12 W) or less, depending on the optical efficiency of the dome itself. This solution, however, would typically require complete removal of the previous dome light fixture to install the new one. (Utilizing LED lamps in a traditional dome light would generally result in the premature failure of those lamps, because incandescent dome lights are not constructed in a manner that would allow the LED lamps to run cool.)

BRIEF SUMMARY

Typically, the most desired general illumination fixture for mid- to upper-end homes in the United States (and in many other countries) is the recessed downlight. Solid state options are now plentiful for this type of fixture, including a wide variety from Cree, Inc. (LR6, LR6-DR650, LR6-DR1000, CR6, etc.; see www.cree.com). Despite the large number of recessed downlights sold per year (sixty to eighty million) and the even larger installed base (about one billion), as noted above, the predominant lighting fixture in specification homes is the dome light.

Because (as noted above) dome lights are comparatively inexpensive, provide adequate light in a relatively even distribution, and in some cases do not require anything other than a simple junction box in a ceiling to install, dome lights are even more widely used than recessed downlights.

When a dome light is being removed, all things being equal, many homeowners (probably a large majority) would prefer to replace that fixture with a recessed downlight rather than with another dome light. Installing a recessed downlight would generally require removing a junction box (that served the dome light being removed) from the ceiling, cutting the ceiling opening to accommodate the new recessed downlight can, installing the new recessed downlight can (at additional labor and materials cost) and then installing the recessed downlight (e.g., one that contains one or more solid state light emitters, e.g., one or more LEDs).

In some aspects, the present inventive subject matter is directed to a lighting device that allows for the removal of a dome light and the installation of a lighting device that makes it possible to mimic the functionality of a recessed downlight, without the necessity of removing a junction box and installing a recessed downlight can. The removal of a dome light and installation of a lighting device according to the present inventive subject matter can be done (1) because the dome light is malfunctioning, (2) to provide improve energy efficiency, (3) to reduce or eliminate the need for frequent change-outs, or (4) for other reasons (e.g., to provide an appearance that more closely resembles a recessed downlight can. The lighting devices according to the present inventive subject matter can also be used in new construction, and/or to add lighting to existing construction in locations where no lighting existed previously (e.g., to add a fourth light fixture to a room that previously included three light fixtures).

In accordance with some aspects of the present inventive subject matter, there is provided a lighting device that comprises a trim element and at least a first solid state light emitter. In some embodiments according to these aspects of the present inventive subject matter, the trim element is configured to be positioned with a first part of the trim element in a first space, and with the first solid state light emitter in the first part of the trim element.

In accordance with a first aspect of the present inventive subject matter, there is provided a lighting device that comprises a junction box, a trim element and at least a first solid state light emitter, regions of the junction box defining a junction box space; regions of the trim element defining a trim element space, at least a first portion of the trim element space within the junction box space, and the first solid state light emitter within the first portion of the trim element space.

In some embodiments in accordance with the first aspect of the present inventive subject matter, the first solid state light emitter is recessed from the front of the junction box, e.g., the junction box comprises a back wall and one or more side walls, the first solid state light emitter is spaced from a first plane defined by points on the one or more side walls that are farthest from the back wall, and the first solid state light emitter is between the first plane and the back wall.

In some embodiments in accordance with the first aspect of the present inventive subject matter, the junction box is mounted in a construction surface (e.g., a ceiling a wall, a floor, etc, for example, made of drywall or wood), the trim element comprises at least a first flange region, and the first flange region is in contact with the construction surface.

In some embodiments in accordance with the first aspect of the present inventive subject matter, the lighting device further comprises a power supply within the junction box space.

In some embodiments in accordance with the first aspect of the present inventive subject matter, the lighting device further comprises at least a first diffuser, and the first diffuser is within the junction box space.

In accordance with a second aspect of the present inventive subject matter, there is provided a lighting device that comprises a trim element and at least a first solid state light emitter, the trim element comprising at least a first region and a second region, the trim element configured to be positioned with at least a first part of the first region in a first space and the second region outside the first space, the first solid state light emitter within the first part of the first region.

In some embodiments in accordance with the second aspect of the present inventive subject matter, the first region is concave.

In some embodiments in accordance with the second aspect of the present inventive subject matter, the first part of the first region is configured to fit within a junction box.

In some embodiments in accordance with the second aspect of the present inventive subject matter, the first space is defined by regions of a junction box.

In some embodiments in accordance with the second aspect of the present inventive subject matter, the first part of the first region is configured to fit within a junction box space defined by regions of a junction box that comprises a back wall and one or more side walls with the first solid state light emitter (1) spaced from a first plane defined by points on the one or more side walls that are farthest from the back wall and (2) between the first plane and the back wall.

In some embodiments in accordance with the second aspect of the present inventive subject matter, the second region of the trim element comprises at least a first flange region, and the trim element is configured to be positioned with (1) at least the first part of the first region in a junction box space defined by regions of a junction box mounted in a construction surface and (2) the first flange region in contact with the construction surface. In some embodiments in accordance with the second aspect of the present inventive subject matter, the lighting device further comprises at least a first diffuser, and the first diffuser is within the first space.

In accordance with a third aspect of the present inventive subject matter, there is provided a lighting device that comprises a trim element and at least a first solid state light emitter, the trim element comprising at least a first region and a second region, a portion of an exterior of the trim element defining a first space, at least a first part of the first region within the first space, the first space having a depth of not larger than 2⅛ inches, a width of not larger than 4 inches and a length of not larger than 4 inches, the first solid state light emitter within the first part of the first region.

In some embodiments in accordance with the third aspect of the present inventive subject matter, the first region is concave.

In some embodiments in accordance with the third aspect of the present inventive subject matter, the second region of the trim element comprises at least a first flange region, and the trim element is configured to be positioned with at least the first part of the first region in a junction box space defined by regions of a junction box mounted in a construction surface and to have the first flange region in contact with the construction surface.

In some embodiments in accordance with the third aspect of the present inventive subject matter, the lighting device further comprises a power supply, and the trim element and the power supply are configured to be positioned with at least the first part of the first region and the power supply in a space defined by regions of a junction box.

In some embodiments in accordance with the third aspect of the present inventive subject matter, the lighting device further comprises at least a first diffuser, and the first diffuser is within the first space.

In some embodiments in accordance with the third aspect of the present inventive subject matter, the trim element comprises at least a first trim element back region and at least a first trim element sidewall, the first trim element sidewall extends from the first trim element back region, and the first solid state light emitter is on the first trim element back region.

In accordance with a fourth aspect of the present inventive subject matter, there is provided a method of installing a light emitter, comprising inserting at least a first part of a first region of a trim element into a first space defined by regions of a junction box, with a second region of the trim element outside the first space, at least a first solid state light emitter within the first part of the first region.

In some embodiments in accordance with the fourth aspect of the present inventive subject matter, the method further comprises removing a lighting device from engagement with the junction box before inserting at least the first part of the first region of the trim element into the first space.

In some embodiments in accordance with the fourth aspect of the present inventive subject matter, the first region is concave.

In accordance with a fourth aspect of the present inventive subject matter, there is provided a method of installing a light emitter, comprising inserting at least a first part of a first region of a trim element into a first space, with a second region of the trim element outside the first space, at least a first solid state light emitter within the first part of the first region.

In some embodiments in accordance with the fifth aspect of the present inventive subject matter, the first space is defined by regions of a junction box. In some of such embodiments, the method further comprises removing a lighting device from engagement with the junction box before inserting at least the first part of the first region into the first space.

In some embodiments in accordance with the fifth aspect of the present inventive subject matter, the first region is concave.

The inventive subject matter may be more fully understood with reference to the accompanying drawings and the following detailed description of the inventive subject matter.

BRIEF DESCRIPTION OF THE DRAWING FIGURES

DETAILED DESCRIPTION

Figure 1:
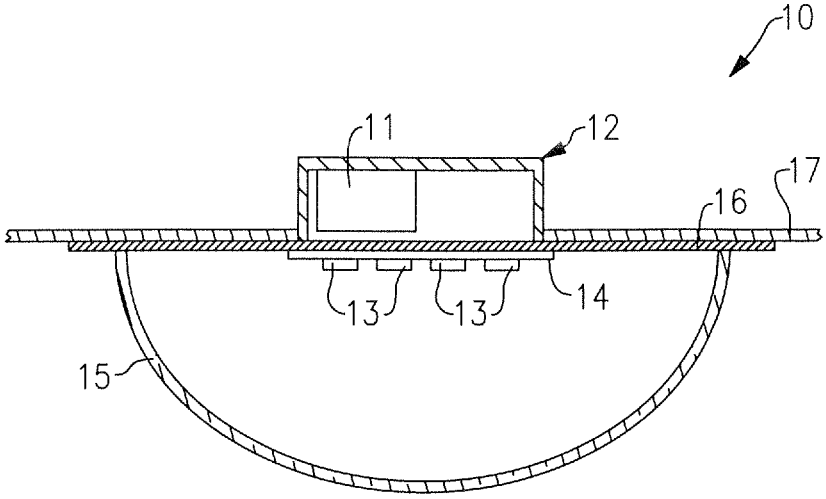
FIG. 1 is a sectional view of a typical layout for an LED dome lamp 10.

The present inventive subject matter now will be described more fully hereinafter with reference to the accompanying drawings, in which embodiments of the inventive subject matter are shown. However, this inventive subject matter should not be construed as being limited to the embodiments set forth herein. Rather, these embodiments are provided so that this disclosure will be thorough and complete, and will fully convey the scope of the inventive subject matter to those skilled in the art. Like numbers refer to like elements throughout.

As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on", being mounted "on", being mounted "to", or extending "onto" another element, it can be in or on the other element, and/or it can be directly on the other element, and/or it can extend directly onto the other element, and it can be in direct contact or indirect contact with the other element (e.g., intervening elements may also be present). In contrast, when an element is referred to herein as being "directly on" or extending "directly onto" another element, there are no intervening elements present. Also, when an element is referred to herein as being "connected" or "coupled" to another element, it can be directly connected or coupled to the other element, or intervening elements may be present. In contrast, when an element is referred to herein as being "directly connected" or "directly coupled" to another element, there are no intervening elements present. In addition, a statement that a first element is "on" a second element is synonymous with a statement that the second element is "on" the first element.

The expression "in contact with", as used herein, means that the first structure that is in contact with a second structure is in direct contact with the second structure or is in indirect contact with the second structure. The expression "in indirect contact with" means that the first structure is not in direct contact with the second structure, but that there are a plurality of structures (including the first and second structures), and each of the plurality of structures is in direct contact with at least one other of the plurality of structures (e.g., the first and second structures are in a stack and are separated by one or more intervening layers). The expression "direct contact", as used in the present specification, means that the first structure which is "in direct contact" with a second structure is touching the second structure and there are no intervening structures between the first and second structures at least at some location.

A statement herein that two components in a device are "electrically connected," means that there are no components electrically between the components that affect the function or functions provided by the device. For example, two components can be referred to as being electrically connected, even though they may have a small resistor between them which does not materially affect the function or functions provided by the device (indeed, a wire connecting two components can be thought of as a small resistor); likewise, two components can be referred to as being electrically connected, even though they may have an additional electrical component between them which allows the device to perform an additional function, while not materially affecting the function or functions provided by a device which is identical except for not including the additional component; similarly, two components which are directly connected to each other, or which are directly connected to opposite ends of a wire or a trace on a circuit board, are electrically connected. A statement herein that two components in a device are "electrically connected" is distinguishable from a statement that the two components are "directly electrically connected", which means that there are no components electrically between the two components.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Relative terms, such as "below", "above," or "horizontal" may be used herein to describe one element's relationship to another element (or to other elements) as illustrated in the Figures. Such relative terms are intended to encompass different orientations of the device in addition to the orientation depicted in the Figures. For example, if the device in the Figures is turned over, elements described as being below other elements would then be oriented above the other elements. The exemplary term "below" can therefore encompass both an orientation of "below" and "above," depending on the particular orientation of the figure.

The expression "illumination" (or "illuminated"), as used herein when referring to a light emitter, means that at least some current is being supplied to the light emitter to cause the light emitter to emit at least some electromagnetic radiation (e.g., visible light). The expression "illuminated" encompasses situations where the light emitter emits electromagnetic radiation continuously, or intermittently at a rate such that a human eye would perceive it as emitting electromagnetic radiation continuously or intermittently, or where a plurality of light emitters of the same color or different colors are emitting electromagnetic radiation intermittently and/or alternatingly (with or without overlap in "on" times), e.g., in such a way that a human eye would perceive them as emitting light continuously or intermittently (and, in some cases where different colors are emitted, as separate colors or as a mixture of those colors).

The expression "excited", as used herein when referring to luminescent material, means that at least some electromagnetic radiation (e.g., visible light, UV light or infrared light) is contacting the luminescent material, causing the luminescent material to emit at least some light. The expression "excited" encompasses situations where the luminescent material emits light continuously, or intermittently at a rate such that a human eye would perceive it as emitting light continuously or intermittently, or where a plurality of luminescent materials that emit light of the same color or different colors are emitting light intermittently and/or alternatingly (with or without overlap in "on" times) in such a way that a human eye would perceive them as emitting light continuously or intermittently (and, in some cases where different colors are emitted, as a mixture of those colors).

The expression "lighting device", as used herein, is not limited, except that it indicates that the device is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/cohunn mounts), ceiling fixtures/wall sconces, under cabinet lighting; lamps (floor and/or table and/or desk), landscape lighting, track lighting, task lighting, specialty lighting, ceiling fan lighting, archival/art display lighting, high vibration/impact lighting, work lights, etc., mirrors/vanity lighting, or any other light emitting device.

The present inventive subject matter further relates to an illuminated enclosure (the volume of which can be illuminated uniformly or non-uniformly), comprising an enclosed space and at least one lighting device according to the present inventive subject matter, wherein the lighting device illuminates at least a portion of the enclosed space (uniformly or non-uniformly).

Some embodiments of the present inventive subject matter are directed to a structure comprising a surface and at least one lighting device corresponding to any embodiment of a lighting device according to the present inventive subject matter as described herein, wherein if at least one solid state light emitter in the lighting device is illuminated, the lighting device would illuminate at least a portion of the surface.

The present inventive subject matter is further directed to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, etc., having mounted therein or thereon at least one lighting device as described herein.

The expression "annular", as used herein, means a structure that extends around an unfilled region, and which can otherwise be of any general shape, and any cross-sections can be of any shape. For example, "annular" encompasses ring-like shapes which can be defined by rotating a circle about an axis in the same plane as, but spaced from, the circle (one example being where the center of the circle is a constant distance from a single point on the axis throughout the entire rotation, and where at each stage during the rotation, the circle lies in a plane in which the axis also lies, i.e., a "circular annular" shape). "Annular" likewise encompasses shapes which can be defined by rotating a square (or any other two-dimensional shape) about an axis in the same plane as, but spaced from, the square. "Annular" likewise encompasses shapes that can be defined by moving any shape from a first position and orientation, through space along any path without ever moving to a position where part of the shape occupies a space previously occupied by any part of the shape, and eventually returning to the first position and orientation. "Annular" likewise encompasses shapes that can be defined by moving any shape from a first position and orientation, through space along any path without ever moving to a position where part of the shape occupies a space previously occupied by any part of the shape, and eventually returning to the first position and orientation, and where the shape and size of the shape being moved can be altered at any time, and any number of times, during its movement.

The expression "axis of emission", as used herein in connection with light output from one or more light emitters, means an axis of the light emission from the light emitter, a direction of maximum brightness of light emission, or a mean direction of light emission (in other words, in the case of mean direction of light emission, (1) if there is provided a light emitter in which the distribution of the brightness of emitted light is non-Lambertian, e.g., if the distribution of the brightness of emitted light is doughnut-shaped (e.g., the light emitter might itself be toroidal or annular, or a plurality of light emitters might be arranged in a toroidal or annular pattern), e.g., with directions of maximum brightness extending around the doughnut shape in the form of a circle extending about a polar axis, e.g., at about 120 vertical degrees (and extending around the entire 360 lateral degrees, i.e., to define a circle) in a Type C coordinate system, i.e., in which the polar axis is vertical, vertical angles range from 0 degrees (nadir) to 180 degrees (zenith) (90 vertical degrees being equatorial), and lateral angles range from 0 degrees to 360 degrees, the axis of emission might coincide with the vertical axis (e.g., because the mean direction of the maxima lies on the vertical axis), even though the maximum directions of brightness do not themselves lie on the vertical axis, or (2) if the maximum brightness is in a first direction, but a brightness in a second direction ten (or fifty) degrees to one side of the first direction is larger than a brightness in a third direction ten (or fifty) degrees to an opposite side of the first direction, the mean direction of light emission would be moved somewhat toward the second direction as a result of the brightnesses in the second direction and the third direction).

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

As noted above, in some aspects, the present inventive subject matter is directed to a lighting device that comprises a trim element and at least a first solid state light emitter.

A trim element (or regions or portions thereof) in the lighting devices according to the present inventive subject matter can generally be of any suitable size and shape. As detailed herein, different aspects of the present inventive subject matter specify that different characteristics that relate to size and shape for the trim element (or regions or portions thereof) be satisfied.

For example, in some embodiments in accordance with the present inventive subject matter, including some embodiments that include or do not include any of the features described herein, the trim element comprises at least a first region and a second region, the trim element is configured to be positioned with at least a first part of the first region in a first space and the second region outside the first space, and at least the first solid state light emitter is within the first part of the first region.

In some embodiments in accordance with the present inventive subject matter, including some embodiments that include or do not include any of the features described herein, the trim element comprises at least a first region and a second region, a portion of an exterior of the trim element defines a first space, at least a first part of the first region is within the first space, the first space has a depth of not larger than 2⅛ inches, a width of not larger than 4 inches and a length of not larger than 4 inches, and at least the first solid state light emitter is within the first part of the first region.

In some embodiments in accordance with the present inventive subject matter, including some embodiments that include or do not include any of the features described herein, the trim element comprises at least a first region and a second region, and the first region is concave.

In some embodiments in accordance with the present inventive subject matter, including some embodiments that include or do not include any of the features described herein, the trim element comprises at least a first region and a second region, the first part of the first region is configured to fit within a junction box space defined by regions of a junction box that comprises a back wall and one or more side walls with the first solid state light emitter (1) spaced from a first plane defined by points on the one or more side walls that are farthest from the back wall and (2) between the first plane and the back wall.

In some embodiments in accordance with the present inventive subject matter, including some embodiments that include or do not include any of the features described herein, the trim element comprises at least a first region and a second region, and the first part of the first region is configured to fit within a junction box.

In some embodiments in accordance with the present inventive subject matter, including some embodiments that include or do not include any of the features described herein, the trim element comprises at least a first region and a second region, and the second region extends from the first region.

In some embodiments in accordance with the present inventive subject matter, including some embodiments that include or do not include any of the features described herein, the trim element comprises at least a first region and a second region, the trim element is configured to be positioned with at least a first part of the first region in a first space and the second region outside the first space, and the first part of the first region is configured to fit within a junction box which defines a junction box space having a depth of not larger than 2⅛ inches, a width of not larger than 4 inches and a length of not larger than 4 inches.

In some embodiments in accordance with the present inventive subject matter, including some embodiments that include or do not include any of the features described herein, the trim element comprises at least a first region and a second region, the trim element is configured to be positioned with at least a first part of the first region in a first space, and the first space is defined by regions of a junction box.

In some embodiments in accordance with the present inventive subject matter, including some embodiments that include or do not include any of the features described herein, the trim element comprises at least a first trim element back region and at least a first trim element sidewall, the first trim element sidewall extends from the first trim element back region, and the first solid state light emitter is on the first trim element back region.

In some embodiments in accordance with the present inventive subject matter, including some embodiments that include or do not include any of the features described herein, the trim element comprises at least a first region and a second region, the trim element is configured to be positioned with at least a first part of the first region in a first space and the second region outside the first space, the second region comprises at least a first flange region, and the trim element is configured to be positioned with (1) at least the first part of the first region in a junction box space defined by regions of a junction box mounted in a construction surface and (2) the first flange region in contact with the construction surface. In some of such embodiments: (1) at least a first portion of the first flange region is spaced farther from an axis of emission of the first solid state light emitter than any portion of the first part of the first region, or (2) the first flange region is annular, and every point on the first flange region is spaced from an axis of emission of the first solid state light emitter a distance at least as large as the largest distance that any portion of the first part of the first region is spaced from the axis of emission of the first solid state light emitter.

In some embodiments in accordance with the present inventive subject matter, including some embodiments that include or do not include any of the features described herein, the trim element comprises at least a first region and a second region, the trim element is configured to be positioned with at least a first part of the first region in a first space and the second region outside the first space, the second region comprises at least a first flange region that comprises at least a first planar surface, and the trim element is configured to be positioned with (1) at least the first part of the first region in a junction box space defined by regions of a junction box mounted in a construction surface, (2) the first planar surface of the first flange region in contact with the construction surface, (3) at least a majority of the junction box to a first side of a plane defined by the first planar surface, and (4) the first solid state light emitter spaced from the plane defined by the first planar surface and to the first side of the plane defined by the first planar surface.

The trim element can comprise any suitable material, a wide variety of which are well known to persons of skill in the art. Representative examples of materials that are suitable for the trim element to comprise include, among a wide variety of other materials, spun aluminum, powder metallurgy formed aluminum, stamped aluminum, die cast aluminum, rolled or stamped steel, hydroformed aluminum, injection molded metal, injection molded thermoplastic, compression molded or injection molded thermoset, molded glass, liquid crystal polymer, polyphenylene sulfide (PPS), clear or tinted acrylic (PMMA) sheet, cast or injection molded acrylic, thermoset bulk molded compound or other composite material. In some embodiments in accordance with the present inventive subject matter, including some embodiments that include or do not include any of the features described herein, the trim element can comprise one or more material that is/are a good conductor of heat (e.g., having a heat conductivity of at least 1 W/m-K).

The trim element can include highly reflective white material such as MCPET® (from Furukawa) or DLR (from Dupont), e.g., on a surface that defines a trim element space in which one or more solid state light emitters is/are located.

The size and/or shape of a trim element can be selected (optionally taking into account the size and/or shape of a junction box to which the trim element is planned to be engaged) to provide desired appearance, degree of light mixing, and/or capability for heat exchange. For example, a second trim element that has a back wall and frustoconical side walls extending at a particular angle relative to the back wall can be selected to have longer frustoconical side walls (in comparison to those of a first trim element that has a back wall that has the same size and shape as in the second trim element, and that has frustoconical side walls that extend from the back wall at the same angle relative to the back wall as in the second trim element) in order to provide a different appearance (i.e., protruding farther into the room), greater light mixing and greater heat exchange with room air.

Any suitable solid state light emitter (or solid state light emitters) can be employed in the lighting devices according to the present inventive subject matter. Persons of skill in the art are familiar with, and have ready access to, a wide variety of solid state light emitters. Representative examples of solid state light emitters include light emitting diodes (inorganic or organic, including polymer light emitting diodes (PLEDs)) and a wide variety of luminescent materials as well as combinations (e.g., one or more light emitting diodes and/or one or more luminescent materials).

The solid state light emitter(s) in any lighting device according to the present inventive subject matter can be of any suitable size (or sizes), e.g., and any quantity (or respective quantities) of solid state light emitters of one or more sizes can be employed. In some instances, for example, a greater quantity of smaller solid state light emitters can be substituted for a smaller quantity of larger solid state light emitters, or vice-versa.

Light emitting diodes are semiconductor devices that convert electrical current into light. A wide variety of light emitting diodes are used in increasingly diverse fields for an ever-expanding range of purposes. More specifically, light emitting diodes are semiconducting devices that emit light (ultraviolet, visible, or infrared) when a potential difference is applied across a p-n junction structure. There are a number of well known ways to make light emitting diodes and many associated structures, and the present inventive subject matter can employ any such devices.

A light emitting diode produces light by exciting electrons across the band gap between a conduction band and a valence band of a semiconductor active (light-emitting) layer. The electron transition generates light at a wavelength that depends on the band gap. Thus, the color of the light (wavelength) and/or the type of electromagnetic radiation (e.g., infrared light, visible light, ultraviolet light, near ultraviolet light, etc., and any combinations thereof) emitted by a light emitting diode depends on the semiconductor materials of the active layers of the light emitting diode.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package that encapsulates the light emitting diode.

A luminescent material is a material that emits a responsive radiation (e.g., visible light) when excited by a source of exciting radiation. In many instances, the responsive radiation has a wavelength (or hue) that is different from the wavelength (or hue) of the exciting radiation.

Luminescent materials can be categorized as being down-converting, i.e., a material that converts photons to a lower energy level (longer wavelength) or up-converting, i.e., a material that converts photons to a higher energy level (shorter wavelength).

Persons of skill in the art are familiar with, and have ready access to, a variety of luminescent materials that emit light having a desired peak emission wavelength and/or dominant emission wavelength, or a desired hue, and any of such luminescent materials, or any combinations of such luminescent materials, can be employed, if desired. One type of luminescent material are phosphors, which are readily available and well known to persons of skill in the art. Other examples of luminescent materials include scintillators, day glow tapes and inks that glow in the visible spectrum upon illumination with ultraviolet light.

One non-limiting representative example of a luminescent material that can be employed in the present inventive subject matter is cerium-doped yttrium aluminum garnet (aka "YAG:Ce" or "YAG"). Another non-limiting representative example of a luminescent material that can be employed in the present inventive subject matter is CaAlSiN:Eu2+ (aka "CASN" or "BR01"), and a further example of a type of luminescent material is BOSE.

The one or more luminescent materials can be provided in any suitable form. For example, the luminescent element can be embedded in a resin (i.e., a polymeric matrix), such as a silicone material, an epoxy material, a glass material or a metal oxide material, and/or can be applied to one or more surfaces of a resin, to provide a lumiphor.

The solid state light emitter (or solid state light emitters) can be arranged in any suitable way. Persons of skill in the art will readily identify a large number of different possible arrangements, any of which (or any combination of which) can be employed in the lighting devices according to the present inventive subject matter.

The solid state light emitter (or the solid state light emitters) can be positioned in any suitable way. In some embodiments, for example, the solid state light emitter (or the solid state light emitters), or some of two or more solid state light emitters, can be on one or more circuit boards (which can be positioned in any suitable way, e.g., on the trim element (e.g., on a back region of the trim element). In some embodiments, the solid state light emitter (or the solid state light emitters), or some of two or more solid state light emitters, can be directly on the trim element (e.g., on a back region of the trim element) (in such embodiments, suitable structure for supplying electricity to the solid state light emitter(s) can be provided, e.g., one or more contacts, one or more terminals and/or one or more conductive traces can be provided).

One or more solid state light emitters can be positioned, attached and/or mounted in any suitable way, e.g., by using chip on heat sink mounting techniques, by soldering (e.g., if a solid state light emitter is mounted on a metal core printed circuit board (MCPCB), flex circuit or even a standard PCB, such as an FR4 board with thermal vias), for example, solid state light emitters can be mounted using substrate techniques such as from Thermastrate Ltd of Northumberland, UK. If desired, the surface of the structure on which the solid state light emitter is mounted, attached or positioned, and/or the one or more solid state light emitters can be machined or otherwise formed to be of matching topography so as to provide high heat sink surface area.

In some lighting devices in which the solid state light emitter or one or more of the solid state light emitters is/are mounted directly on the trim element, one or more thermal element can be provided that is on the trim element in a location where it can serve a specific solid state light emitter or group of solid state light emitters. A representative example of a suitable thermal element is a projection that extends from the side of the trim element that is opposite the side on which the solid state light emitter(s) is/are mounted. A thermal element can be made of any suitable material, and can be of any suitable shape. Use of materials having higher heat conductivity in making the thermal element(s) generally provides greater heat transfer, and use of thermal element(s) of larger surface area and/or cross-sectional area generally provides greater heat transfer. Representative examples of materials that can be used to make the thermal element(s), if provided, include metals, diamond, DLC, etc.

As noted above, in some aspects, the present inventive subject matter is directed to a lighting device that comprises a junction box, a trim element and at least a first solid state light emitter. In some embodiments in accordance with the present inventive subject matter, including some embodiments that include or do not include any of the features described herein, regions of the junction box define a junction box space, regions of the trim element definr a trim element space, at least a first portion of the trim element space is within the junction box space, and at least the first solid state light emitter is within the first portion of the trim element space. The descriptions of the options and structures for the trim element and the one or more solid state light emitters set forth above apply to the trim element and the one or more solid state light emitters in these aspects of the present inventive subject matter.

As noted above, some embodiments of lighting devices according to the present inventive subject matter can comprise a junction box, and/or one or more structures (or one or more parts or portions of structures) can be configured so as to fit within (or to be able to be positioned within) a junction box space defined by regions of a junction box.

Persons of skill in the art are familiar with a wide variety of junction boxes (and dimensions thereof), and any of such junction boxes can be employed in lighting devices in accordance with the present inventive subject matter, and/or any of the dimensions of any of such junction boxes can be applicable in lighting devices in accordance with the present inventive subject matter.

In some embodiments according to the present inventive subject matter that include a junction box, or in which one or more structures (or one or more parts or portions of structures) can be configured so as to fit within (or to be able to be positioned within) a junction box, the junction box, or the junction box with respect to which the configuration of the structures (or one or more parts or portions of structures) of the lighting device is specified has one or more of the following characteristics:

regions of the junction box define a junction box space, and said regions of the junction box define a junction box space having a depth of not larger than 2⅛ inches, a width of not larger than 4 inches and a length of not larger than 4 inches;

the junction box comprises a back wall and one or more side walls, the first solid state light emitter is spaced from a first plane defined by points on the one or more side walls that are farthest from the back wall, and the first solid state light emitter is between the first plane and the back wall;

the junction box is mounted in a construction surface, the trim element comprises at least a first flange region, and the first flange region is in contact with the construction surface;

the junction box is mounted in a construction surface, the trim element comprises at least a first flange region, the first flange region is in contact with the construction surface, the first flange region comprises at least a first planar surface, the first planar surface is in contact with the construction surface, at least a majority of the junction box is to a first side of a plane defined by the first planar surface, the first solid state light emitter is spaced from the plane defined by the first planar surface, and the first solid state light emitter is to the first side of the plane defined by the first planar surface;

regions of the junction box define a junction box space, and the lighting device further comprises a power supply within the junction box space; and the trim element comprises at least a first region and a second region, the lighting device further comprises a power supply, the trim element and the power supply are configured to be positioned with at least a first part of the first region and the power supply in a space defined by regions of a junction box.

Persons of skill in the art are familiar with a variety of conventional junction boxes, and their dimensions. Representative examples of conventional junction boxes include:

junction boxes having a generally square back wall and four side walls extending from the four respective edges of the square back wall and in directions substantially perpendicular to a plane defined by the back wall, defining a junction box space that has a depth of between about 1¼ inches and about 2⅛ inches (e.g., about 1¼ inches or about 2⅛ inches), a width of about 4 inches and length of about 4 inches, in which planes parallel to the back wall that pass through the junction box space intersect with the junction box space in substantially square regions that are each about 4 inches by about 4 inches;

junction boxes having a generally octagonal back wall and eight side walls extending from the eight respective edges of the octagonal back wall and in directions substantially perpendicular to a plane defined by the back wall, defining a junction box space that has a depth of between about 1¼ inches and about 2⅛ inches (e.g., about 1¼ inches or about 2⅛ inches), a width of about 4 inches and length of about 4 inches, in which planes parallel to the back wall that pass through the junction box space intersect with the junction box space in substantially octagonal regions that are each about 4 inches by about 4 inches with equivalent portions of each of the four corners cut off;

junction boxes having a generally circular back wall and an annular side walls extending from the circular back wall and in directions substantially perpendicular to a plane defined by the back wall, defining a substantially cylindrical junction box space that has a depth of between about 1¼ inches and about 2⅛ inches (e.g., about 1¼ inches or about 2⅛ inches), and a diameter of about 4 inches (i.e., planes parallel to the back wall that pass through the junction box space intersect with the junction box space in substantially circular regions that are each about 4 inches in diameter).

In embodiments according to the present inventive subject matter that include a junction box, the junction box can comprise any suitable material or materials. Persons of skill in the art are familiar with a variety of materials that junction boxes can comprise. Representative examples of materials that junction boxes can comprise include metals and plastics.

Trim elements in the lighting devices according to the present inventive subject matter can have any suitable structure(s) or component(s) for assisting in attaching the trim element to a junction box. For example, a trim element can have one or more holes through which screws can be inserted for engagement into screwholes in a junction box (in such embodiments, the holes in the trim element can be arranged to correspond to screwholes in the junction box). Alternatively or additionally, a trim element can comprise one or more mechanical structures that can engage a junction box (e.g., a trim element can have one or more biased flanges (e.g., outwardly biased), e.g., that are spring-loaded and/or that have structural memory, and that can for example be retracted (or otherwise be pushed inward) while inserting the trim element into a junction box, and then the structure(s) can be released so that it/they is/are pushed outward (after the trim element is inserted into the junction box), and the structure(s) can hold (or assist in holding) the trim element in place relative to the junction box (e.g., by exerting force against structure that is part of the junction box or connected to the junction box, by physically engaging structure that is part of the junction box or connected to the junction box, and/or by resting on structure that is part of the junction box or connected to the junction box, e.g., gravitational force holds the structure on the trim element on structure that is part of the junction box or connected to the junction box).

In some embodiments of lighting devices according to the present inventive subject matter, there can be provided one or more structures that allow a lighting device to be accommodated in junction boxes of different sizes and/or shapes (e.g., a snap-out flange can be provided that can engage structure in junction boxes of different sizes and/or shapes, and/or different sized and/or shaped flanges can be provided that can be selected that can hold a lighting device in place relative to junction boxes of respective different sizes and/or shapes.

In any lighting device according to the present inventive subject matter, there can be provided one or more structures that cover any portion or portions of the lighting device, or component(s) thereof, e.g., a plastic cosmetic ring can be provided to cover screws used to hold the trim element in place relative to a junction box. Any such structure or structures can be held in place relative to the lighting device by any suitable structure, e.g., flexible structures that have protrusions that can snap into corresponding recesses (and/or flexible structures that have recesses into which corresponding protrusions can be received).

As noted above, some embodiments according to the present inventive subject matter comprise a power supply that is within a space defined by regions of a junction box, and/or comprise a trim element and a power supply which are configured to be positioned with at least the first part of a first region of the trim element and the power supply in a space defined by regions of a junction box.

In some embodiments in accordance with the present inventive subject matter that comprise a power supply, a power supply can comprise any electronic components that are suitable for a lighting device, for example, any of (1) one or more electrical components employed in converting electrical power (e.g., from AC to DC and/or from one voltage to another voltage), (2) one or more electronic components employed in driving one or more light emitter, e.g., running one or more light emitter intermittently and/or adjusting the current supplied to one or more light emitters in response to a user command, a detected change in intensity or color of light output, a detected change in an ambient characteristic such as temperature or background light, etc., and/or a signal contained in the input power (e.g., a dimming signal in AC power supplied to the lighting device), etc., (3) one or more circuit boards (e.g., a metal core circuit board) for supporting and/or providing current to any electrical components, and/or (4) one or more wires connecting any components, e.g. electronic components such as linear current regulated supplies, pulse width modulated current and/or voltage regulated supplies, bridge rectifiers, transformers, power factor controllers etc.

In some embodiments in accordance with the present inventive subject matter that comprise a power supply (e.g., in some embodiments that comprise a power supply that is within a space defined by regions of a junction box, or that is configured to be able to fit within such a space), the overall size of the power supply can be reduced or minimized by using a high voltage electricity supply (e.g., a boost configuration), by using a high frequency operation (e.g., 1 GHz or higher), and/or any other suitable way.

In some embodiments in accordance with the present inventive subject matter that comprise a power supply (e.g., in some embodiments that comprise a power supply that is within a space defined by regions of a junction box, or that is configured to be able to fit within such a space), the power supply can be divided into two or more sections, whereby one or more sections of the power supply can be within the space (or can be able to fit within such a space) and one or more sections of the power supply can be outside the space (or can be able to be outside the space), or two or more section of the power supply can be within different regions of the space (or can be able to fit within different regions of such a space).

Components in lighting devices according to the present inventive subject matter can be electrically connected to one another, or to supplied energy (e.g., line voltage), in any suitable way, a wide variety of which are well known to those of skill in the art and a wide variety of which would be readily apparent to those of skill in the art. In some embodiments in accordance with the present inventive subject matter (e.g., embodiments that comprise a power supply that is within a space defined by regions of a junction box, or that is configured to be able to fit within such a space), electrical connection to one or more components of the lighting device can be accomplished using screw terminals (e.g., on an exterior of a power supply housing, if included), or with poke-home connections (similar to wiring methods used for typical electrical outlets), or any other type of connection that assists in saving space (e.g., within a junction box).

In some embodiments, drive circuitry can be provided to achieve some degree of power factor correction. Persons of skill in the art are familiar with a variety of power factor controllers (PFCs), and any of such power factor controllers can be employed, if desired, in the lighting devices in accordance with the present inventive subject matter. In some embodiments, there can be provided a lighting device that may have a power factor of greater than 0.7 and in some embodiments a power factor of greater than 0.9.

Some embodiments in accordance with the present inventive subject matter can include one or more diffusion elements and/or one or more obscuration elements. Persons of skill in the art are familiar with a wide variety of diffusion elements (i.e., elements that assist in color mixing), and a wide variety of obscuration elements (i.e., volumetric regions and/or surface features), and can readily envision a variety of materials out of which a diffusion element or an obscuration element can be made, and are familiar with and/or can envision a wide variety of shapes that such elements can be. Any of such materials and/or shapes (e.g., films) can be employed in a diffusion element and/or an obscuration element in an embodiment that includes such an element (or elements). As will be understood by persons skilled in the art, a diffusion element or an obscuration element according to the present inventive subject matter can be selected based on their respective effects on incident light. For example, a diffusion element can include features to diffuse or scatter light, such as scattering particles dispersed within the element (e.g., particles made from titanium dioxide, alumina, silicon carbide, gallium nitride, or glass micro spheres).

In embodiments in accordance with the present inventive subject matter that include a diffusion element (or plural diffusion elements), the diffusion element (or diffusion elements) can be positioned in any suitable location and orientation.

For example, in embodiments that comprise a first flange region, a diffuser can be provided which is in contact with at least the first flange region.

In embodiments in which a trim element is provided that comprises at least a first region and a second region, the trim element configured to be positioned with at least a first part of the first region in a first space and the second region outside the first space, a diffuser can be provided which is within the first space.

In embodiments in which a trim element is provided that comprises at least a first region and a second region and a portion of an exterior of the trim element defines a first space, a diffuser can be provided which is within the first space.

In embodiments in which a junction box is included, a first diffuser can be provided within a junction box space defined by the junction box.

A diffusion element, if included, can be provided, for example, by a random array of light diffusing features, such as a randomly sized and/or spaced microlens array. For instance, a representative example of a suitable diffusion layer (if included) can be a Light Shaping Diffuser (LSD®), distributed by Liminit, which can provide 85%-92% transmission in a wide wavelength range of 360-1600 nm as described, for example, in a Liminit Datasheet entitled "*LED Lighting Applications*" and at the Liminit website at the IP address 216.154.222.249. Other representative examples of suitable low absorption diffusers, if included, can be one or more of the ADF series of diffusion films distributed by Fusion Optix, as described at fusionptix.com and in an article "*Lighting: Obscuration of LEDs*", diffusion films provided by ACEL, or diffusion films distributed by Bright View Technologies as described at brightviewtechologies.com.

In some embodiments in accordance with the present inventive subject matter, which can include or not include, as suitable, any of the other features described herein (e.g., the possible inclusion of one or more diffusers), light exiting from the lighting device can have good uniformity of color hue. The expression "good uniformity of color hue", as used herein, can indicate that when light emitters are emitting light, each of at least 50 (and in some instances 100, 200, 300, 500 or 1,000) non-overlapping conceptual square regions of approximately equal size (not physically defined, but instead defined by imaginary lines) of a region through which light exits the lighting device have a color hue that is within 0.01 unit of a first color point on a 1976 CIE Chromaticity Diagram (each of the non-overlapping square regions comprising a corresponding percentage of a total surface area of the exit region, e.g., each of 50 square regions comprising 1/50 of the total surface area, or each of 100 square regions comprising 1/100 of the total surface area, or each of 500 square regions comprising 1/500 of the total surface area, etc.). In some situations, "good uniformity of color hue" (and/or "good uniformity of emitted light color") can be assessed based on whether or not the color hue uniformity requirements of the L Prize are met. In some situations, "good uniformity of color hue" (and/or "good uniformity of emitted light color") can mean that there is less than 500 K CCT variation over the surface of a region through which light exits the lighting device.

In some embodiments in accordance with the present inventive subject matter, which can include or not include, as suitable, any of the other features described herein, light exiting from the lighting device can have good uniformity of brightness. The expression "good uniformity of brightness", as used herein, can indicate (1) that when the light exiting from the lighting device is directed toward a first surface (e.g., in some cases, a relatively flat surface, e.g., in some cases, that is generally perpendicular to a first line connecting the lighting device (or a center of an emission surface of the lighting device) and the point of maximun emission), there are no regions (patches) on the first surface where the brightness of light emitted from the lighting device is significantly different from neighboring regions (patches), or there or no significant rings of light (where the brightness of light emitted from the lighting device significantly differs from the brightness of light emitted from the lighting device in neighboring rings, e.g., if a first region on the first surface is defined as points where a line connecting the point with a center of an emission surface of the lighting device defines an angle of between 0 and 2.5 degrees relative to the first line, a second region on the first surface is defined as points where a line connecting the point with a center of an emission surface of the lighting device defines an angle of between 2.5 and 5 degrees relative to the first line, a third region on the first surface is defined as points where a line connecting the point with a center of an emission surface of the lighting device defines an angle of between 5 and 7.5 degrees relative to the first line, a fourth region on the first surface is defined as points where a line connecting the point with a center of an emission surface of the lighting device defines an angle of between 7.5 and 10 degrees relative to the first line, an average brightness of light emitted from the lighting device in the first region is great than that in the second region, which is in turn greater than that in the third region, which is in turn greater than that in the fourth region, or (2) that any suitable light distribution defined by the Illumination Engineering Society is satisfied, or (3) that when one or more light emitters emit light, each of at least 1000 non-overlapping conceptual square regions (again, not physically defined, but instead defined by imaginary lines) of a region through which light exits the lighting device have a brightness that is within 5 percent of a first brightness (each of the at least 1000 non-overlapping square regions comprising 0.08 percent of a total surface area of the region through which light exits the lighting device).

One or more diffusers can be readily removable from the lighting device, e.g., mechanical engagement between the lighting device and the diffuser(s) can be provided by one or more flexible structures (for example, a periphery of a diffuser can have protrusions that are receivable in corresponding recesses in the trim element, and/or a diffuser can have recesses in which corresponding protrusions in the trim element are receivable, and/or a diffuser can be screw threaded into corresponding threads on a trim element, and/or a bayonet-type connection can be provided, whereby a diffuser is pushed up, then rotated, to provide engagement, etc.

As noted above, in some embodiments in accordance with the present inventive subject matter, a junction box (in which at least a portion of a lighting device according to the present inventive subject matter can fit) can be mounted in a construction surface (e.g., a ceiling, a wall or a floor, for example, made of drywall or wood). In such embodiments, a lighting device according to the present inventive subject matter can be flush-mounted to the construction surface, or can be spaced from the construction surface in any suitable way. In some embodiments in accordance with the present inventive subject matter, one or more accessory to provide directional lighting and/or shielding, etc. For example, in some embodiments, a half-hemispherical dome structure (that is reflective in its inside surface) can be provided on a wall-mounted lighting device, with the half-hemispherical structure mounted so that it has a first periphery in a plane substantially parallel to the wall and defining a semi-circular curve that extends upward in the middle, and a second periphery that is also semi-circular and that is substantially horizontal, to direct emitted light downward, to act as a nightlight, a light for illuminating artwork from above, a light for illuminating a walkway, etc. (in other embodiments, such a dome could be flipped so that it directs light upward, or an accessory (which can be movable, if desired) can be in any other suitable shape and orientation.

In some embodiments, the lighting devices are configured to provide lumen output of any specific quantity, e.g., at least 500 lumens, and in some embodiments, at least 600 lumens, at least 700 lumens, at least 800 lumens, at least 900 lumens, at least 1,000 lumens, at least 1,500 lumens, at least 2,000 lumens, at least 2,500 lumens, at least 3,000 lumens, at least 4,000 lumens, or more.

In some aspects of the present inventive subject matter, which can include or not include any of the features described elsewhere herein, there are provided lighting devices that provide at least 75% of the lumen output of the lamp for which the lighting device is a replacement, and in some cases, at least 85%, 90%, 95%, 100%, 105%, 110%, 115%, 120% or 125% of the lumen output of the lamp for which the lighting device is a replacement.

In some aspects of the present inventive subject matter, which can include or not include any of the features described elsewhere herein, there are provided lighting devices that can provide an expected L70 lifetime of at least 25,000 hours. Lighting devices according to some embodiments of the present inventive subject matter provide expected L70 lifetimes of at least 35,000 hours, and lighting devices according to some embodiments of the present inventive subject matter provide expected L70 lifetimes of at least 50,000 hours. Energy can be supplied to the lighting device from any source or combination of sources, for example, the grid (e.g., line voltage), one or more batteries, one or more photovoltaic energy collection devices (i.e., a device that includes one or more photovoltaic cells that convert energy from the sun into electrical energy), one or more windmills, etc.

Any suitable heat transfer structure(s) and/or heat dissipation structure(s), a wide variety of which are well known by those of skill in the art, can be employed in the lighting devices according to the present inventive subject matter. Such heat transfer structure(s) and/or heat dissipation structure(s) can comprise one or more passive cooling features and/or one or more active cooling features (i.e., cooling that is achieved through the use of some form of energy, as opposed to "passive cooling", which is achieved without the use of energy; that is, while energy is supplied to the light emitters in the lighting device, passive cooling is the cooling that would be achieved without the use of any component(s) that would require additional energy in order to function to provide additional cooling). Thermal grease, thermal pads, graphite sheets or other techniques known to those of skill in the art may be used to increase the thermal coupling between components or between respective regions of components.

As noted above, in some aspects of the present inventive subject matter, there is provided a method of installing a light emitter, comprising inserting at least a first part of a first region of a trim element into a first space defined by regions of a junction box, with a second region of the trim element outside the first space, at least a first solid state light emitter within the first part of the first region. In such methods, the descriptions of trim elements, solid state light emitters, junctions boxes and other components are applicable to descriptions of such methods.

In some embodiments, methods according to the present inventive subject matter can further comprise removing a lighting device from engagement with the junction box before inserting at least the first part of the first region of the trim element into the first space. The expression "removing a lighting device from engagement with the junction box," as used herein, can encompass changing the location of a lighting device (1) from an arrangement in which the entirety of the lighting device is within a junction box space defined by regions of the junction box to an arrangement in which the entirety of the lighting device is outside the junction box space, (2) from an arrangement in which the entirety of the lighting device is within a junction box space defined by regions of the junction box to an arrangement in which a portion of the lighting device is outside the junction box space, (3) from an arrangement in which a portion of the lighting device is within a junction box space defined by regions of the junction box to an arrangement in which the entirety of the lighting device is outside the junction box space, or (4) from an arrangement in which a portion of the lighting device is within a junction box space defined by regions of the junction box to an arrangement in which a portion of the lighting device is outside the junction box space. Such removing of a lighting device can involve detachment of one or more structures of the lighting device being removed from one or more other structures (e.g., detaching an electrical connection to the junction box and/or to one or more components located in the junction box space), and/or changing of the location of the lighting device being removed.

As noted above, in some aspects of the present inventive subject matter, there is provided a method of installing a light emitter, comprising inserting at least a first part of a first region of a trim element into a first space, with a second region of the trim element outside the first space, at least a first solid state light emitter within the first part of the first region. In some embodiments according to such aspects, the method can further comprise removing a lighting device from engagement with the junction box before inserting at least the first part of the first region into the first space.

Embodiments in accordance with the present inventive subject matter are described herein in detail in order to provide exact features of representative embodiments that are within the overall scope of the present inventive subject matter. The present inventive subject matter should not be understood to be limited to such detail.

Embodiments in accordance with the present inventive subject matter are also described with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as being limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

The lighting devices illustrated herein are illustrated with reference to cross-sectional drawings. These cross-sections may be rotated around a central axis to provide lighting devices that are circular in nature. Alternatively, the cross-sections may be replicated to form sides of a polygon, such as a square, rectangle, pentagon, hexagon or the like, to provide a lighting device. Thus, in some embodiments, objects in a center of the cross-section may be surrounded, either completely or partially, by objects at the edges of the cross-section.

FIG. 1 is a sectional view of a typical layout for an LED dome lamp 10. The lamp 10 comprises a junction box 12 mounted (e.g., using nails or screws attached to ceiling joists) in a construction surface 17 (e.g., a ceiling made of drywall), a base plate 16 attached (e.g., using screws) to a junction box, an LED circuit board 14 mounted on the base plate 16, LEDs 13 mounted on the LED board 14, and a glass or polymer dome 15 mounted on the base plate 16. Electronics (e.g., a power supply 11) are housed in the junction box 12 to reduce or minimize shadows that might otherwise disrupt the light distribution from the LEDs 13 on the dome 15. The LED circuit board 14 is mounted such that the dome 15 is illuminated fairly evenly, and thermal energy can be conducted through the base plate 16 to the outside air beyond the dome 15.

Figure 2:
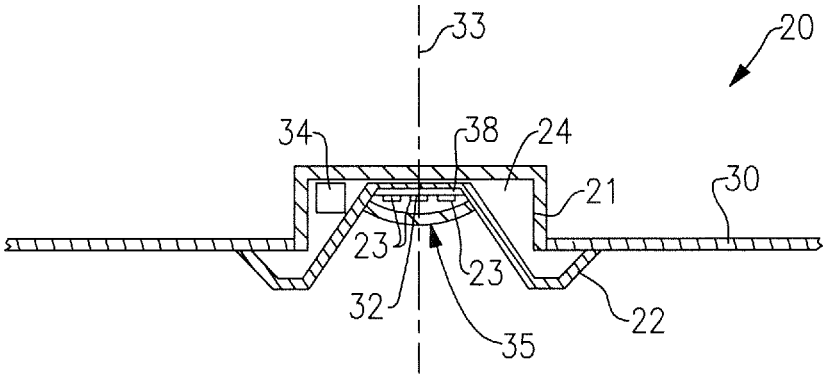
FIG. 2 is a sectional view of a lighting device 20 according to the present inventive subject matter.

FIG. 2 is a sectional view of a lighting device 20 according to the present inventive subject matter. Referring to FIG. 2, the lighting device 20 comprises a junction box 21, a trim element 22 and a plurality of solid state light emitters 23. Regions of the junction box 21 define a junction box space 24

Figure 3:
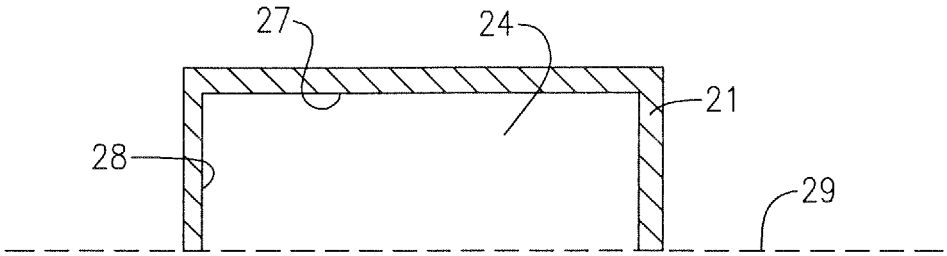
FIG. 3 depicts a junction box in the lighting device depicted in FIG. 2.
Figure 4:
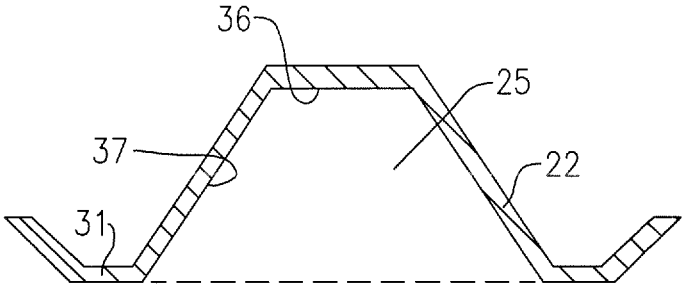
FIG. 4 depicts a trim element in the lighting device depicted in FIG. 2.
Figure 5:
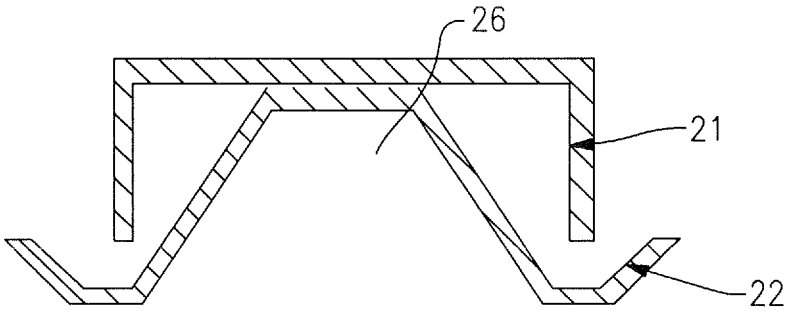
FIG. 5 depicts only the junction box and the trim element in the lighting device depicted in FIG. 2.

(see FIG. 3, which depicts the junction box 21 by itself). Regions of the trim element 22 define a trim element space 25 (see FIG. 4, which depicts the trim element 22 by itself). A first portion 26 of the trim element space 25 is within the junction box space 24 (see FIG. 5, which depicts the trim element 22 and the junction box by themselves). The solid state light emitters 23 are within the first portion 26 of the trim element space 25.

The regions of the junction box 21 that define the junction box space 24 have a depth of not larger than 2⅛ inches, a width of not larger than 4 inches and a length of not larger than 4 inches, i.e., the junction box space has a depth of not larger than 2⅛ inches, a width of not larger than 4 inches and a length of not larger than 4 inches (e.g., the junction box space 24 has a depth of about 2⅛ inches (or 1¼ inches), a width of about 4 inches and a length of about 4 inches).

The junction box 21 comprises a back wall 27 and one or more side walls 28. The solid state light emitters 23 are spaced from a first plane 29 defined by points on the one or more side walls 28 that are farthest from the back wall 27, and the solid state light emitters 23 are between the first plane 29 and the back wall 27.

The junction box 21 is mounted in a construction surface 30 (e.g., a ceiling made of drywall). The trim element 22 comprises a first flange region 31 which is in contact with the construction surface 30. At least a first portion of the first flange region 31 is spaced farther from an axis of emission 33 of a first solid state light emitter 32 than any point within the first portion 26 of the trim element space 25.

The lighting device 20 is substantially symmetrical relative to the axis 33, i.e., the first flange region 31 is substantially circular annular. Every point on the first flange region 31 is spaced from the axis 33 a distance at least as large as the largest distance that any point within the first portion 26 of the trim element space 25 is spaced from the axis 33.

The lighting device 20 further comprises a power supply 34 within the junction box space 24.

The lighting device 20 further comprises a first diffuser 35 that is within the junction box space 24.

The trim element 22 comprises at least a first trim element back region 36 and at least a first trim element sidewall 37. The first trim element sidewall 37 extends from the first trim element back region 36. The first solid state light emitter 32 is on the first trim element back region 36.

The lighting device 20 provides a very compact replacement light that utilizes the depth of the junction box 21 to provide optical shielding of the light emitter in a way very similar to a recessed downlight. The plurality of solid state light emitters 23 can be mounted on an LED board 38 that has the ability to reject heat directly into the room air through the trim element 22 (e.g., which can be a continuous structure made of metal). In order to provide additional optical shielding, the trim element 22 may protrude into the room beyond the ceiling plane, or in instances where less optical shielding is necessary may only extend a material thickness beyond the ceiling plane. The power supply 34 can be a miniature power supply to allow for much of the space in the junction box 21 to be consumed by the trim element 22, the LED board 38 and the diffuser 35.

Among the advantages of lighting devices according to the present inventive subject matter, e.g., a lighting device 20 as depicted in FIG. 2, are:

- minimal materials for low cost;
- allow the homeowner to upgrade to a recessed downlight look and feel without the cost and hassle of installing a downlight can;
- maintains "heat sink in the room" advantage;
- minimal conduction distance from the LED board (or the one or more solid state light emitter) to room air provides the potential for utilizing lower thermal conductivity materials or manufacturing methods for trim element.

The capability to recess one or more solid state light emitters (and/or an LED board, if included) and a power supply (if included) into a junction box also allows for a very low profile solid state light emitter dome light replacement, e.g., as shown in FIG. 2.

Figure 6:
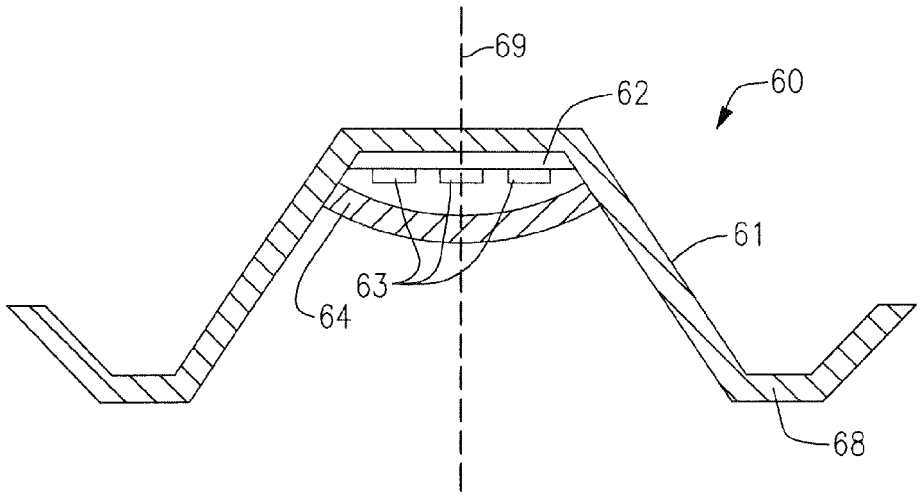
FIG. 6 is a sectional view of a lighting device 60 according to the present inventive subject matter.

FIG. 6 is a sectional view of a lighting device 60 according to the present inventive subject matter. As shown in FIG. 6, the lighting device 60 comprises a trim element 61, an LED board 62 (namely, a metal core printed circuit board), LEDs 63, and a diffuser 64. The trim element 61 (see FIG. 7, which depicts the trim element 61 by itself) comprises a first region 65 (referring to FIG. 7, the portion of the trim element 61 that is above (in the orientation depicted in FIG. 7) the plane 67), and a second region 66 (referring to FIG. 7, the portion of the trim element 61 that is below (in the orientation depicted in FIG. 7) the plane 67).

The trim element 61 is configured to be positioned with at least a first part 70 of the first region 65 (in the embodiment depicted in FIGS. 6 and 7, the first part 70 comprises the entirety of the first region 65 of the trim element 61) in a first space (e.g., a space defined as a portion of a space defined by the trim element 61 that is configured to be within a junction box space, or a space defined by a portion of the exterior of the trim element 61), and the second region 66 of the trim element 61 outside the first space, and with the LEDs 63 (i.e., solid state light emitters) within the first part 70 of the first region 65 of the trim element 61.

Figure 7:
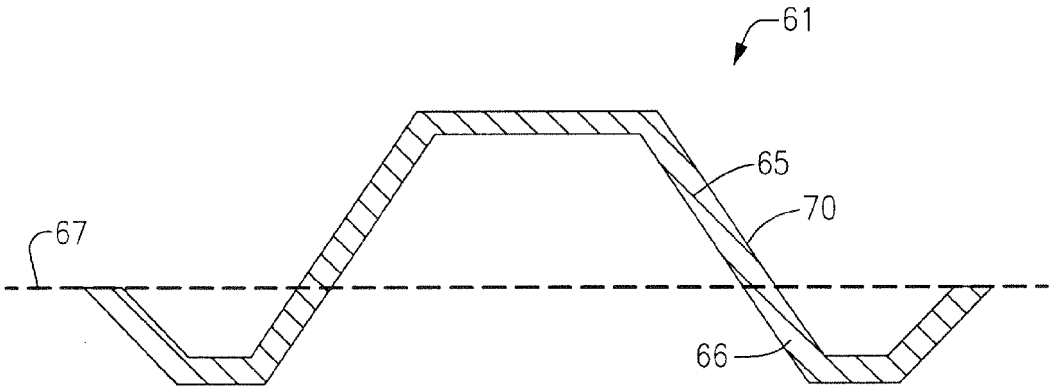
FIG. 7 depicts a trim element in the lighting device depicted in FIG. 6.

Referring to FIGS. 6 and 7, the first region 65 of the trim element 61 is concave.

The first part 70 of the first region 65 of the trim element 61 is configured to fit within a junction box space defined by regions of a junction box that comprises a back wall and one or more side walls with the first solid state light emitter (1) spaced from a first plane defined by points on the one or more side walls that are farthest from the back wall and (2) between the first plane and the back wall, e.g., the first part 70 of the first region 65 of the trim element 61 is configured to fit within a junction box space in a manner analogous to how analogous portions of the lighting device 20 depicted in FIG. 2 fits within the junction box 21.

An alternative embodiment is similar to the embodiment depicted in FIGS. 6 and 7, and further includes a power supply, and the lighting device is configured such that a first part of a first region of the trim element and the power supply are configured to fit within a junction box space.

The second region 66 of the trim element 61 comprises an annular flange region 68, and the trim element 61 is configured to be positioned with (1) at least the first part 70 of the first region 65 in a junction box space defined by regions of a junction box mounted in a construction surface and (2) the annular flange region 68 in contact with the construction surface.

The lighting device 60 is substantially symmetrical relative to an axis 69.

Figure 8:
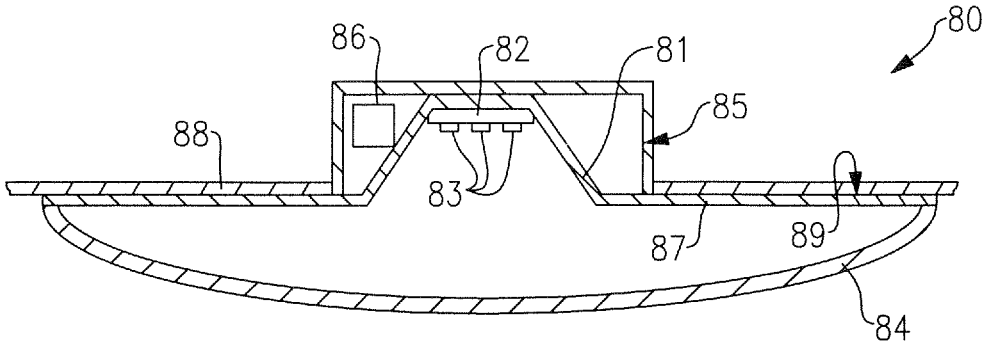
FIG. 8 is a sectional view of a lighting device 80 according to the present inventive subject matter.

FIG. 8 is a sectional view of a lighting device 80 according to the present inventive subject matter. As shown in FIG. 8, the lighting device 80 comprises a trim element 81, an LED board 82 (namely, a metal core printed circuit board), LEDs 83, a diffuser 84, a junction box 85 and a power supply 86. The junction box is mounted in a construction surface 88.

The trim element 81 comprises a flange region 87 which comprises a first planar surface 89 which is in contact with the construction surface 88. A majority of the junction box 85 (in this embodiment, the entirety of the junction box 85) is to a first side of a plane defined by the first planar surface 89. The LEDs 83 are spaced from the plane defined by the first planar surface 89 and is to the first side of the plane defined by the first planar surface 89.

The diffuser 84 is in contact with the flange region 87.

Figure 9:
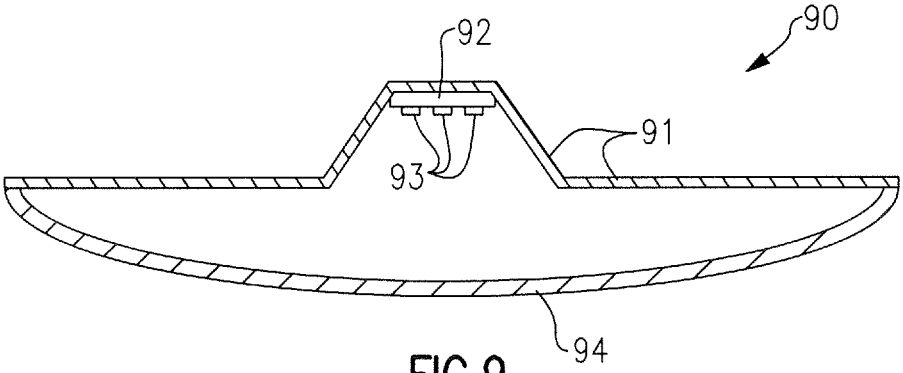
FIG. 9 is a sectional view of a lighting device 90 according to the present inventive subject matter.

FIG. 9 is a sectional view of a lighting device 90 according to the present inventive subject matter. As shown in FIG. 9, the lighting device 90 comprises a trim element 91, an LED board 92 (namely, a metal core printed circuit board), LEDs 93 and a diffuser 94.

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

Any two or more structural parts of the lighting devices described herein can be integrated. Any structural part of the lighting devices described herein can be provided in two or more parts (which may be held together in any known way, e.g., with adhesive, screws, bolts, rivets, staples, etc.).

The invention claimed is:

1. A lighting device, comprising:

a junction box, regions of the junction box defining a junction box space;

a trim element, regions of the trim element defining a trim clement space, at least a first portion of the trim element space within the junction box space;

at least a first solid state light emitter, the first solid state light emitter within the first portion of the trim element space; and a power supply, the power supply within the junction box space;

the trim element comprising at least a first trim element back region and at least a first trim element sidewall, the first trim element sidewall extending from the first trim element back region and defining an obtuse angle relative to the first trim element back region.

2. A lighting device as recited in claim 1, wherein:

said regions of the junction box define a junction box space having a depth of not larger than 2⅛ inches, a width of not larger than 4 inches and a length of not larger than 4 inches.

3. A lighting device as recited in claim 1, wherein:

the junction box comprises a back wall and one or more side walls, the first solid state light emitter is spaced from a first plane defined by points on the one or more side walls that are farthest from the back wall, and the first solid state light emitter is between the first plane and the back wall.

4. A lighting device as recited in claim 1, wherein:

the junction box is mounted in a construction surface, the trim element comprises at least a first flange region, and the first flange region is in contact with the construction surface.

5. A lighting device as recited in claim 4, wherein:

the first flange region comprises at least a first planar surface, the first planar surface is in contact with the construction surface, at least a majority of the junction box is to a first side of a plane defined by the first planar surface, and the first solid state light emitter is spaced from the plane defined by the first planar surface and is to the first side of the plane defined by the first planar surface.

6. A lighting device as recited in claim 4, wherein:

the lighting device further comprises at least a first diffuser, and the first diffuser is in contact with at least the first flange region.

7. A lighting device as recited in claim 4, wherein:

at least a first portion of the first flange region is spaced farther from an axis of emission of the first solid state light emitter than any point within the first portion of the trim element space.

8. A lighting device as recited in claim 4, wherein:

the first flange region is annular;

every point on the first flange region is spaced from an axis of emission of the first solid state light emitter a distance at least as large as the largest distance that any point within the first portion of the trim element space is spaced from the axis of emission of the first solid state light emitter.

9. A lighting device as recited in claim 4, wherein a first portion of the trim element is in the junction box space, a second portion of the trim element extends from the first portion of the trim element to the first flange region, and the second portion of the trim element defines a gap between the trim element and the construction surface.

10. A lighting device as recited in claim 1, wherein the lighting device is configured to emit at least 500 lumens.

11. A lighting device as recited in claim 1, wherein:

the lighting device further comprises at least a first diffuser, and the first diffuser is within the junction box space.

12. A lighting device as recited in claim 1, wherein:

the first solid state light emitter is on the first trim element back region.

13. A lighting device as recited in claim 1, wherein the power supply is outside the trim element space.

14. A lighting device as recited in claim 1, wherein the junction box comprises a back wall and at least a first side wall, and the power supply is between the first trim element sidewall and the first side wall.

15. A lighting device as recited in claim 1, wherein:

the junction box comprises a back wall and one or more side walls, a first plane is defined by points on the one or more side walls that are farthest from the back wall, a cross-sectional area of the trim element space parallel to the first plane increases where the trim element extends through the first plane.

16. A lighting device as recited in claim 1, wherein the first trim element sidewall is frustoconical.

17. A lighting device as recited in claim 1, wherein the junction box comprises a back wall and one or more side walls, the trim element back region in direct contact with the junction box hack wall.

18. A lighting device as recited in claim 17, wherein the power supply is between the trim element sidewall and the junction box back wall.

19. A lighting device as recited in claim 1, wherein the junction box comprises a back wall and at least a first side wall, and the power supply is between the trim element sidewall and the junction box back wall.

20. A lighting device, comprising:

a trim element that comprises at least a first region and a second region, the trim element configured to be positioned with at least a first part of the first region as well as a power supply in a first space defined by regions of a junction box and the second region outside the first space;

at least a first solid state light emitter within the first part of the first region;

the trim element comprising at least a first trim element back region and at least a first trim element sidewall;

the first trim element sidewall extending from the first trim element back region and defining an obtuse angle relative to the first trim element back region.

21. A lighting device as recited in claim 20, wherein the first region is concave.

22. A lighting device as recited in claim 20, wherein:

the first part of the first region is configured to fit within a junction box space defined by regions of a junction box that comprises a back wall and one or more side walls, with the first solid state light emitter spaced from a first plane defined by points on the one or more side walls that are farthest from the back wall, and between the first plane and the back wall.

23. A lighting device as recited in claim 20, wherein:

the first part oldie first region is configured to fit within a junction box which defines a junction box space having a depth of not larger than 2⅛ inches, a width of not larger than 4 inches and a length of not larger than 4 inches.

24. A lighting device as recited in claim 20, wherein:

the second region of the trim element comprises at least a first flange region, and the trim element is configured to be positioned with at least the first part of the first region in a junction box space defined by regions of a junction box mounted in a construction surface and with the first flange region in contact with the construction surface.

25. A lighting device as recited in claim 24, wherein:

the lighting device further comprises at least a first diffuser, and the first diffuser is in contact with at least the first flange region.

26. A lighting device as recited in claim 24, wherein:

at least a first portion of the first flange region is spaced farther from an axis of emission of the first solid state light emitter than any portion of the first part of the first region.

27. A lighting device as recited in claim 24, wherein:

the first flange region is annular;

every point on the first flange region is spaced from an axis of emission of the first solid state light emitter a distance at least as large as the largest distance that any portion of the first part of the first region is spaced from the axis of emission of the first solid state light emitter.

28. A lighting device as recited in claim 20, wherein the lighting device is configured to emit at least 500 lumens.

29. A lighting device as recited in claim 20, wherein:

the lighting device further comprises at least a first diffuser, and the first diffuser is within the first space.

30. A lighting device as recited in claim 20, wherein:

the first solid state light emitter is on the first trim element back region.

31. A lighting device as recited in claim 20, wherein a cross-sectional area defined by points that are on a surface of the first region of the trim element closest to a center axis of the lighting device and are in a first plane perpendicular to the center axis of the lighting device is less than a cross-sectional area defined by points that are on a surface of the second region of the trim element closest to the center axis of the lighting device and are in a second plane perpendicular to the center axis of the lighting device.

32. A lighting device, comprising:

a trim element that comprises at least a first region and a second region, a portion of an exterior of the trim element configured to fit, along with a power supply, in a first space, at least a first part of the first region within the first space, the first space having a depth of not larger than 2⅛ inches, a width of not larger than 4 inches and a length of not larger than 4 inches;

at least a first solid state light emitter within the first part of the first region;

the trim element comprising at least a first trim element back region and at least a first trim element sidewall;

the first trim element sidewall extending from the first trim element back region and defining an obtuse angle relative to the first trim element back region.

33. A lighting device as recited in claim 32, wherein the first region is concave.

34. A lighting device as recited in claim 32, wherein:

the second region of the trim element comprises at least a first flange region, and the trim element is configured to be positioned with at least the first part of the first region in a junction box space defined by regions of a junction box mounted in a construction surface and to have the first flange region in contact with the construction surface.

35. A lighting device as recited in claim 34, wherein:

the first flange region comprises at least a first planar surface, the first planar surface is in contact with the construction surface, at least a majority of the junction box is to a first side of a plane defined by the first planar surface, and the first solid state light emitter is spaced from the plane defined by the first planar surface and is to the first side of the plane defined by the first planar surface.

36. A lighting device as recited in claim 34, wherein:

the lighting device further comprises at least a first diffuser, and the first diffuser is in contact with at least the first flange region.

37. A lighting device as recited in claim 34, wherein:

at least a first portion of the first flange region is spaced farther from an axis of emission of the first solid state light emitter than any portion of the first part of the first region.

38. A lighting device as recited in claim 34, wherein:

the first flange region is annular;

every point on the first flange region is spaced from an axis of emission of the first solid state light emitter a distance at least as large as the largest distance that any portion of the first part of the first region is spaced from the axis of emission of the first solid state light emitter.

39. A lighting device as recited in claim 32, wherein the lighting device is configured to emit at least 500 lumens.

40. A lighting device as recited in claim 32, wherein:

the lighting device further comprises at least a first diffuser, and the first diffuser is within the first space.

41. A lighting device as recited in claim 32, wherein:

the first solid state light emitter is on the first trim element back region.

42. A lighting device comprising:

a trim element, regions of the trim element defining a trim element space, at least a first portion of the trim element space within a junction box space;

at least a first solid state light emitter, the first solid state light emitter within the first portion of the trim element space; and at least a first lens, the trim element comprising at least a first region and a flange region, the flange region comprising a first side and a second side, the second side on an opposite side of the flange region relative to the first side, the trim element configured to be positioned with at least a first part of the first region in a junction box mounted in a construction element and the first side of the flange region in contact with the construction element, the first lens in contact with the second side of the flange region the first part of the first region of the trim element comprising at least a first trim element back region and at least a first trim element sidewall;

the first trim element sidewall extending from the first trim element back region and defining an obtuse angle relative to the first trim element back region.

43. A lighting device as recited in claim 42, wherein the first lens is in contact with the first side of the flange region along a periphery of the second side of the flange region.

44. A lighting device as recited in claim 43, wherein all portions of the first lens are spaced from the flange region except for portions of the first lens that are in contact with the periphery of the second side of the flange region.

45. A method of installing a light emitter, comprising:

inserting at least a first part of a first region of a trim element and a power supply into a first space defined by regions of a junction box, with a second region of the trim element outside the first space, at least a first solid state light emitter within the first part of the first region, the first part of the first region comprising at least a first trim element back region and at least a first trim element sidewall, the first trim element sidewall extending from the first trim element back region and defining an obtuse angle relative to the first trim element back region.

46. A method as recited in claim 45, wherein the method further comprises removing a lighting device from engagement with the junction box before inserting at least the first part of the first region of the trim element into the first space.

47. A method as recited in claim 45, wherein the first region is concave.

* * * * *

UNITED STATES PATENT AND TRADEMARK OFFICE

CERTIFICATE OF CORRECTION

PATENT NO. : 9,151,457 B2
APPLICATION NO. : 13/365844
DATED : October 6, 2015
INVENTOR(S) : Paul Kenneth Pickard et al.

It is certified that error appears in the above-identified patent and that said Letters Patent is hereby corrected as shown below:

Title Page, Other Publications, Page 2

Please change: "Narendran et al., PIER Lighting Research Program Project 2.3 Low-Profile LED Luminaries, Lighting Research Center, California Energy Commission, CLC-500-2005-141-A4, Apr. 2007, 84 pages." to -- Narendran et al., PIER Lighting Research Program Project 2.3 Low-Profile LED Luminaries, Lighting Research Center, California Energy Commission, CEC-500-2005-141-A4, Apr. 2007, 84 pages. --

In the Claims

Col. 25, Line 48, Claim 1

Please change: "clement space, at least a first portion of the trim element" to -- element space, at least a first portion of the trim element --

Col. 27, Line 6, Claim 17

Please change: "junction box hack wall." to -- junction box back wall. --

Col. 27, Line 39, Claim 23

Please change: "the first part oldie first region is configured to fit within a" to -- the first part of the first region is configured to fit within a --

Signed and Sealed this
Eighth Day of March, 2016

Michelle K. Lee

Michelle K. Lee
*Director of the United States Patent and Trademark Office*